US012018681B1

(12) United States Patent
Shaw et al.

(10) Patent No.: US 12,018,681 B1
(45) Date of Patent: Jun. 25, 2024

(54) OIL BOX DEVICE OF A ROOTS VACUUM PUMP WITH A CROSSED COOLING WATER TUBE SET

(71) Applicants: Raymond Zhou Shaw, Shanghai (CN); Guichun Zhang, Shanghai (CN)

(72) Inventors: Raymond Zhou Shaw, Shanghai (CN); Guichun Zhang, Shanghai (CN)

(73) Assignees: ELIVAC INC.; ELIVAC CO., LTD; RAYMOND Z. SHAW, Salisbury, MD (US)

( * ) Notice: Subject to any disclaimer, the term of this patent is extended or adjusted under 35 U.S.C. 154(b) by 0 days.

(21) Appl. No.: 18/197,743

(22) Filed: May 16, 2023

(51) Int. Cl.

| | |
|---|---|
| ***F04C 15/00*** | (2006.01) |
| ***F04C 2/12*** | (2006.01) |
| ***F04C 13/00*** | (2006.01) |
| ***F04C 18/12*** | (2006.01) |
| ***F04C 18/14*** | (2006.01) |
| ***F04C 25/02*** | (2006.01) |
| ***F04C 29/04*** | (2006.01) |
| ***F28D 1/04*** | (2006.01) |
| ***F28D 1/047*** | (2006.01) |

(52) U.S. Cl.
CPC ..... *F04C 15/0096* (2013.01); *F04C 2/126* (2013.01); *F04C 13/00* (2013.01); *F04C 18/126* (2013.01); *F04C 18/14* (2013.01); *F04C 25/02* (2013.01); *F04C 29/04* (2013.01); *F28D 1/04* (2013.01); *F28D 1/047* (2013.01)

(58) Field of Classification Search
CPC .... F01C 1/12–20; F01C 21/001; F01C 21/06; F04C 2/12–20; F04C 18/12–20; F04C 15/0096; F04C 29/0007; F04C 29/04–047
See application file for complete search history.

(56) References Cited

FOREIGN PATENT DOCUMENTS

| | | | |
|---|---|---|---|
| CN | 202851468 U | * | 4/2013 |
| CN | 114941623 A | * | 8/2022 |
| CN | 217950675 U | * | 12/2022 |
| CN | 219061995 U | * | 5/2023 |
| CN | 220015498 U | * | 11/2023 |

* cited by examiner

*Primary Examiner* — Laert Dounis

(57) ABSTRACT

An oil box device of a roots vacuum pump with a crossed cooling water tube set includes an oil box; two root vacuum pump transfer gears placed within the oil box; each gear being axially connected to a respective one of shafts of rotors of a roots vacuum pump; one shaft of the rotors being driven by another one shaft of the rotors; a multiple channel crossed cooling water tube set enclosing the two roots vacuum pump gears; two distal ends of the water tube set being crossed over one another; two water boxes installed at two ends of the water tube set; after assembly, the water tube set enclosing the two gears and two ends of the water tube set being crossed over each other at a lateral side of the two gears; and two joints being installed at a bottom side of the rear cover.

9 Claims, 5 Drawing Sheets

OIL BOX DEVICE OF A ROOTS VACUUM PUMP WITH A CROSSED COOLING WATER TUBE SET

FIELD OF THE INVENTION

The present invention is related to, and in particular to a oil box device of a roots vacuum pump with a crossed cooling water tube set.

BACKGROUND OF THE INVENTION

Roots vacuum pumps are rotational volume changeable vacuum pumps. In that, by a pair of transfer gears, rotors rotate within the pump body with opposite directions. Air flows into the pump from an inlet and then is compressed and finally flows out from an outlet. A pressure difference existed between the inlet and outlet.

In operation of a roots vacuum pump, heat will generate. A sincere defect is that the rotors are possible to be deadly buckled and thus to decrease temperature of the pump. Generally, the roots vacuum pump has two heat sources, one is heat energy from compression of heat, which is concentrated at the pump body, rotors and outlet; another is heat energy from the motion of internal elements, such as wearing of bearings, engagements of gears, and agitation of lubricate oil, etc. These mainly occur in the gear oil box.

In use of roots vacuum pump, operation of rotors will generate heat energy due to air compression. Gaps exist between the rotors and the pump body, or between the end cover and rotors. A small gap causes collision of the elements, while a large gap causes that large returning flow generates at the inlet of the pump, so that the vacuum will deteriorate at the inlet and thus oil will reduce. Therefore, efficiency of the roots vacuum pump decreases.

To assure that the inlet of the roots vacuum pump has a designated vacuum ratio and preferred suction efficiency, the gaps between rotors and pump body and between end cover and rotors are fixed. The air in the inlet will be compressed and then drained out. In compressing process, compression heat energy will generate, so that pressure different in the inlet become large and large, more works require and thus more heat generates within the pump.

The transfer gears of the roots vacuum pump are placed in the oil box formed by an end cover and a rear cover. Lubricate oil in the oil box will lubricate the gears by sputtering injection, meanwhile, the bearings within the end cover and bearing seal are lubricated by lubricated oil which is sputtered from the gears or from an oil disk. If the operation time period is long, the oil temperature will increase.

Heat energy from air compression and operation of the components will transfer in the roots vacuum pump.

If these heat energies are not drained out real time, the heat energies transfer to the rotors, pump body, shaft, end cover, gears, bearings of the roots vacuum pump. These metal components will expand due to heat of the heat energy. Especially, temperature of rotors increase to be over the gaps between the rotors and pump body, the rotors and end cover, rotors so as to have metal collision until the rotors are deadly buckled and thus the roots vacuum pump cannot work normally, even the pump body is destroyed.

If these heat energies cannot be drained in time so that the pump body operates for a long time, the lubricated oil will be destroyed so that the lifetimes of gears, bearings, and sealing of the bearings are shortened. The pump is easy to shock and have noises. Oil temperature increases so that lubrication of bearings and sealing of bearings are insufficient. Furthermore, the static circular friction surface and dynamic circular friction surface for mechanic sealing cannot seal the oil films effectively. It not only greatly increases consumption of friction and reduces lifetime of mechanic sealing, but also oil drainage induces and the vacuum of the roots vacuum pump is unstable.

If the heat energy cannot be drained out real time, internal temperature of the roots vacuum pump will affect the pumping speed and vacuum of the whole roots vacuum pump. The higher the temperature, the lower the pumping speed of the whole roots vacuum pump. As a result, the vacuum to be achieved is decreased.

To dissipation of heat by nature air is very insufficient for a roots vacuum pump. Various ways are needed to be adapted for dissipation of heat generated so as to control temperature within a reasonable range and thus to promote usage, safety and operation efficiency of the roots vacuum pump

SUMMARY OF THE INVENTION

Accordingly, the object of the present invention is to provide a oil box device of a roots vacuum pump with a crossed cooling water tube set, the water tube set 2 has a crossing structure at the ends connected to the water box so that the length of the water tubes within the oil box can be maximized and thus the area for heat exchange is increased. Furthermore, the water tubes of the water tube set are parallel so that flowing cooling water has minimized resistance force and thus the cooling water could flow smoothly. In the structure of the present invention, the water tube set and the joints suspend in the oil box by the water boxes and the rear cover so that the water tubes are arranged above the two gears, that is, in the center of the oil box, which is beneficial to the uniform heat exchange. Therefore, cooling efficiency of the whole water tube set could be increased effectively. Therefore, the defects of too short cooling length, non-smoothness of the cooling water flow, bad cooling effect, inconvenience in detaching and installation, bad sealing after re-installation are resolved. Not only the cooling effect of the roots vacuum pump is incremented, but also the quality, safety and operation efficiency of the roots vacuum pump are also improved.

To achieve above object, the present invention provides an oil box device of a roots vacuum pump with a crossed cooling water tube set, wherein 1. An oil box device of a roots vacuum pump with a crossed cooling water tube set, comprising: an oil box (100)formed by a roots pump rear cover (1) and an end cover (5); the rear cover and the end cover being formed as a cavity; two root vacuum pump transfer gears (4) placed within the oil box (100); the two gears being engaged with one another so that when rotation of one gear will drive another gear to rotate; each gear being axially connected to a respective one of shafts of rotors of a roots vacuum pump; one shaft of the rotors being driven by another one shaft of the rotors; a multiple channel crossed cooling water tube set (2) enclosing the two roots vacuum pump gears (4) and being within the oil box; the cooling water tube set (2) being formed with a plurality of parallel water tubes; two distal ends of the water tube set being crossed over one another; two water boxes (6) installed at two ends of the water tube set (2); after assembly, the water tube set enclosing the two gears and two ends of the water tube set being crossed over each other at a lateral side of the two gears; two joints (3) being installed at a bottom side of the rear cover (1) so that water flows into or out of the water tube set through the joints, the two joints passing through the two through holes of the rear cover and then being connected to the water boxes so that the water tube set are tightly connected to the rear cover; wherein after assembly, the two gears are arranged at inner side of the water tube set so that the water tube set 2 and the water boxes can dissipate heat of the gears; therefore, cooling water can flow into one joint; then flow to one of the two water boxes, then flow to the water tube set; then to another water box, then to another joint and flow out from the another joint.

The water box are connected to a plurality of short tubes (64); the short tubes are connected to the water tube set (2) and two ends of the water tube set are crossed over each other so that in a finite space, length of the water tube is maximized and cool water has longer time to be retained in the oil box so as to increase the heat exchange rate.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 8, the structure of the present invention is illustrated. The present invention includes the following elements.

Figure 1:
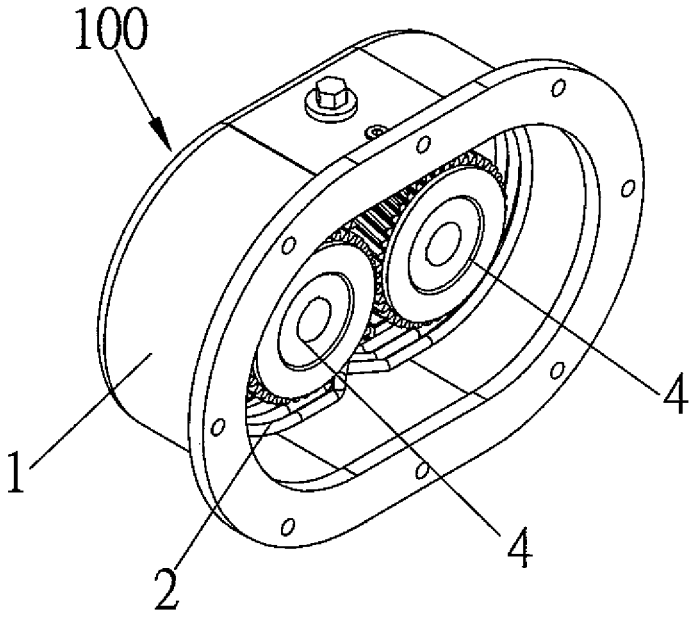
FIG. 1 is a front view of the oil box of the present invention.
Figure 2:
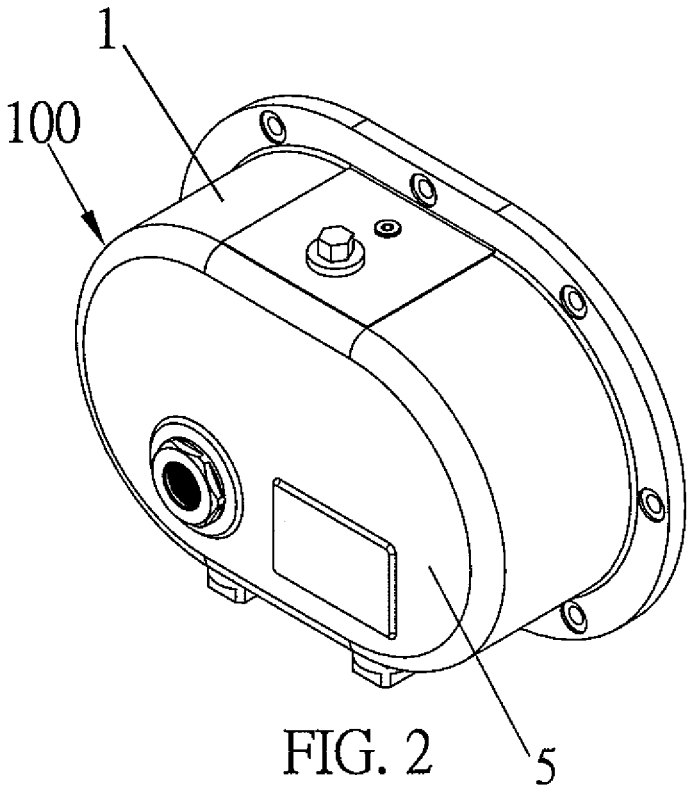
FIG. 2 is a rear view of the oil box of the present invention.

An oil box 100 is formed by a roots pump rear cover 1 and an end cover 5. The rear cover 1 and the end cover 5 are formed with a cavity, as illustrated in FIGS. 1 and 2. The rear cover 1, end cover 5 and a pump (not shown) are connected by studs.

Figure 3:
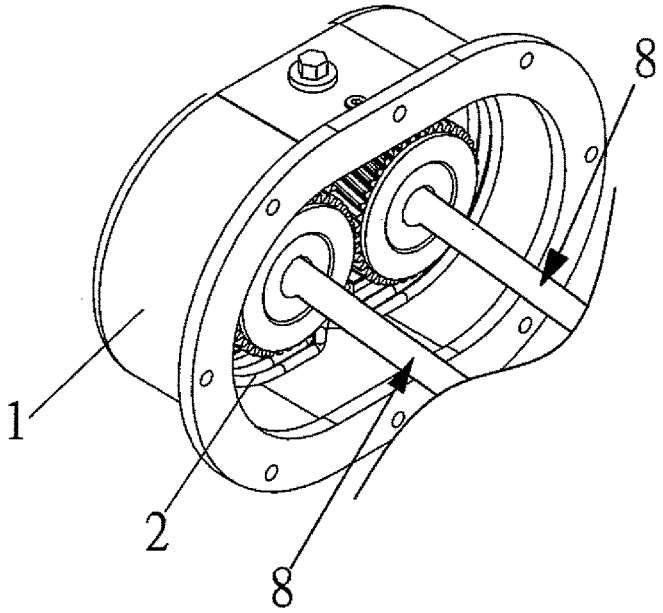
FIG. 3 is a schematic view showing the connection of the oil box with a roots vacuum pump according to the present invention.

Two root vacuum pump transfer gears 4 are placed within the oil box 100. The two gears 4 are lubricated by oil. The two gears 4 are engaged with one another so that when rotation of one gear 4 will drive another gear 4 to rotate. As illustrated in FIG. 3, each gear 4 is axially connected to a respective one of shafts 8 of rotors of a roots vacuum pump. One shaft of the rotor is driven by another one shaft of the rotor.

Figure 4:
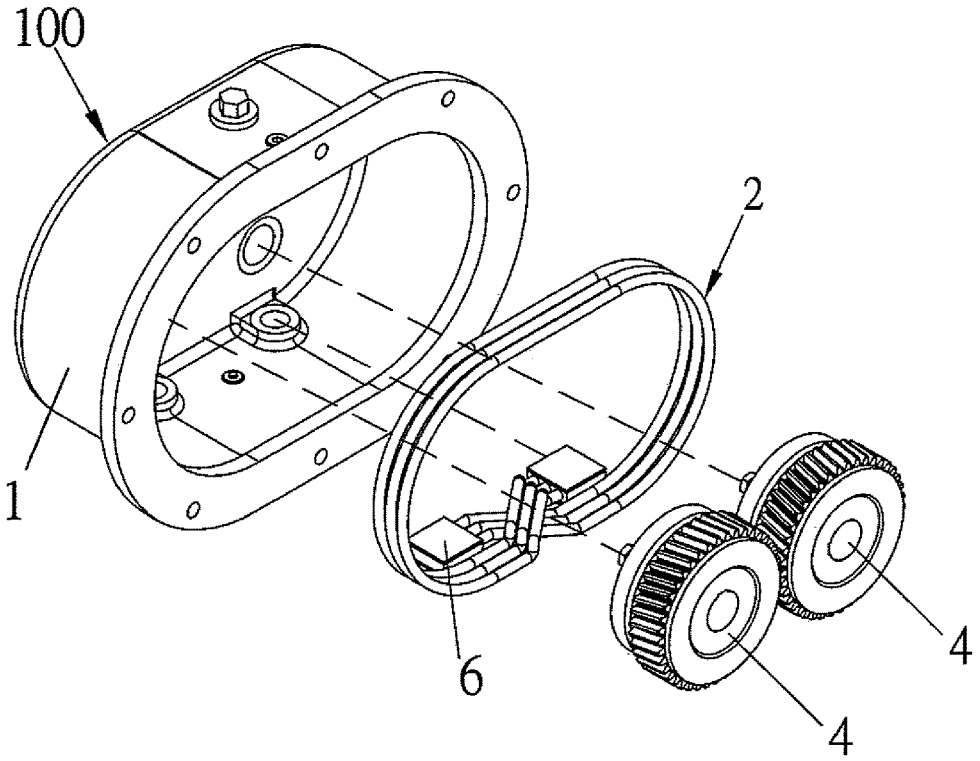
FIG. 4 is an exploded view of an oil box according to the present invention.

A multiple channel crossed cooling water tube set 2 encloses the two roots vacuum pump gears 4 and is within the oil box 100. The cooling water tube set 2 is formed with a plurality of parallel water tubes. Two distal ends of the water tube set 2 are crossed over one another, as illustrated in FIG. 4. In this embodiment, the water tube set 2 has three water tubes, however this is not used to confine the scope of the present invention, any water tube set 2 with intersected ends are within the scope of the present invention.

In the embodiment of the present invention, the water tube set 2 has a gap of 5~8 mm with an inner wall of the rear cover 1, this is A proper design, because if the gap is very small, it will be inconvenient in installation work, and if the gap is too great, the cooling effect will deteriorate. Preferably, the material of the water tube set 2 is stainless steel or yellow copper. For high temperature environment, stainless steel is preferable, since it can prevent deformation of the tube.

Figure 7A:
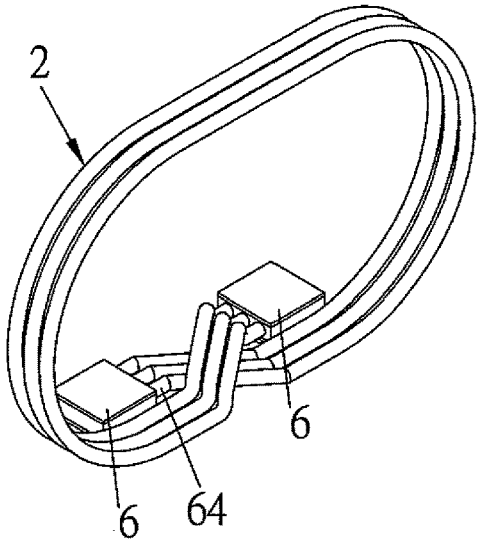
FIG. 7A is a structural view of the multiple channel crossed water tube set according to the present invention.

Two water boxes 6 are installed at two ends of the water tube set 2, as illustrated in FIGS. 4 and 7A. After assembly, the water tube set 2 encloses the two gears 4 and two ends of the water tube set 2 are crossed over each other at a lateral side of the two gears 4.

Figure 7B:
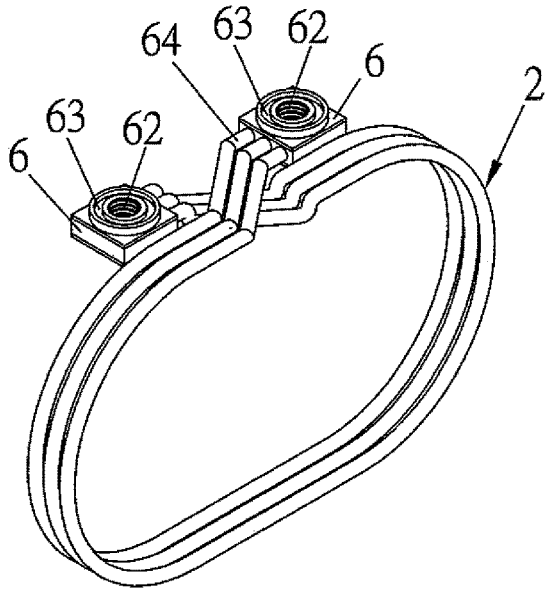
FIG. 7B shows a bottom view of that in FIG. 7A.
Figure 7C:
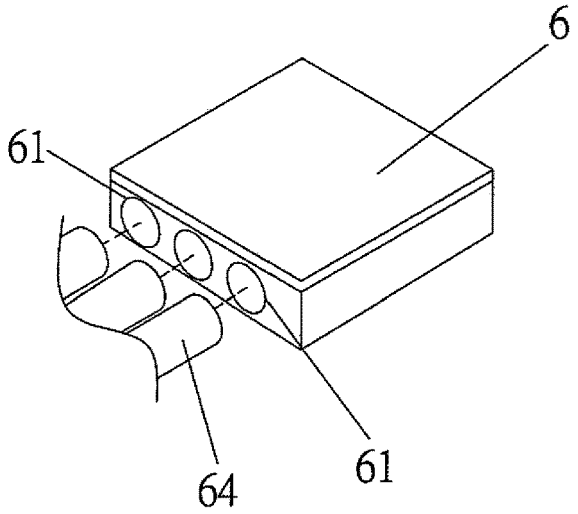
FIG. 7C is a structural view of the water box of the present invention.

Referring to FIGS. 7B and 7C, a lower side of the water box 6 has a hole 62 with inner threads therein and an O shape annular recess 63. A lateral side of the water box 6 has a plurality of water holes 61 the number of which is corresponding to that of the water tubes. The water holes 61 are connected to a plurality of short tubes 64 which are connected preferably by welding. In this embodiment, preferably, the water holes 61 are φ 10 water holes 61, and the short tubes 64 are φ 10 short tubes 64. And the inner threaded hole 62 is M16 inner threaded hole 62.

The short tubes 64 are connected to the water tube set 2 and two ends of the water tube set 2 are crossed over each other so that in a finite space, length of the water tube will be maximized and cool water has longer time to be retained in the oil box 100 so as to increase the heat exchange rate.

After assembly, the two gears 4 are enclosed by the water tube set 2 so as the water tube set 2 and the water boxes 6 can dissipate heat of the roots vacuum pump transfer gears 4.

In the present invention, the water tubes of the water tube set 2 are parallel with the short tubes 64 so that the water flowing therein has minimum resistant force and flows smoothly. The water tube set 2 is connected to the rear cover 1 by the water boxes 6. Therefore, the water tube set 2 can be supported therein and inner space of the oil box 100 so that the plurality of short tubes 64 are conveniently arranged below the gears 4. Heat energy can be interchanged efficiently.

Figure 5:
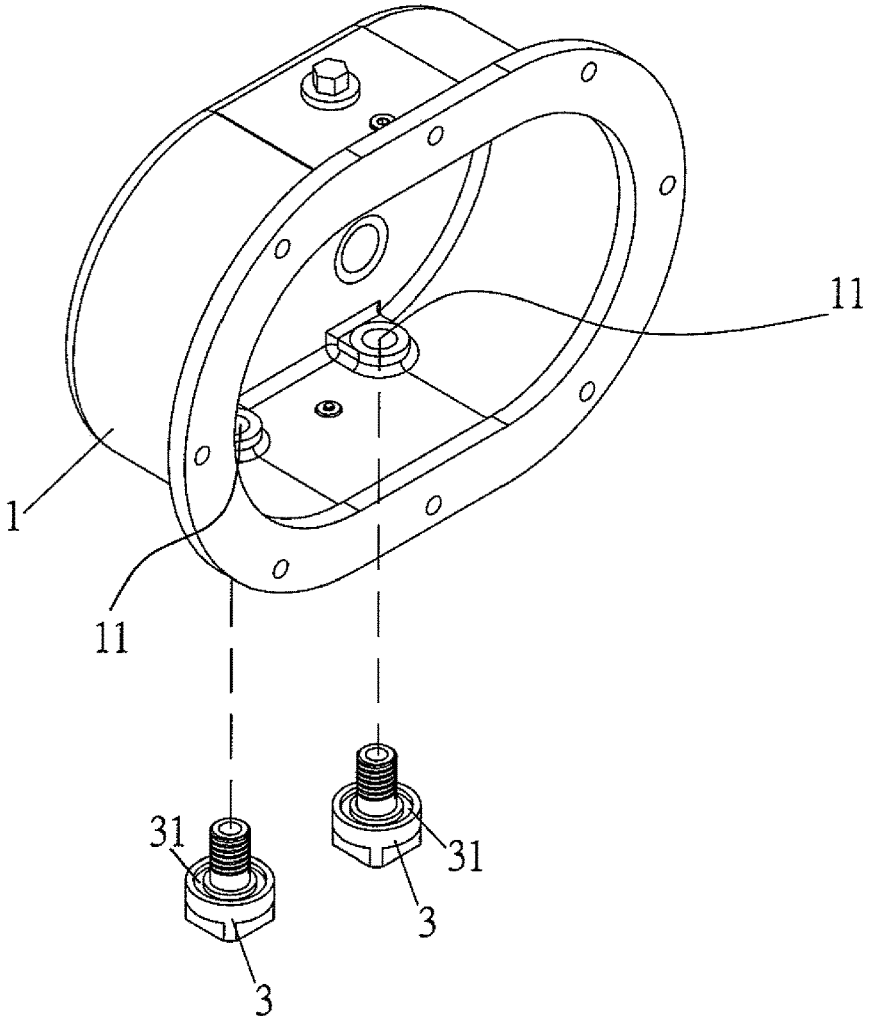
FIG. 5 is a schematic view showing the connection of the oil box with the joints according to the present invention.
Figure 6A:
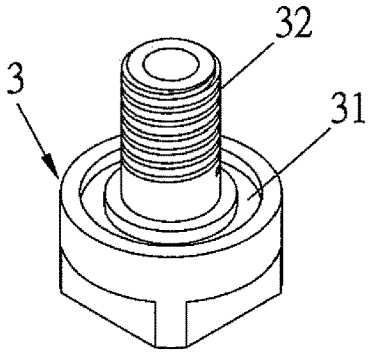
FIG. 6A is a structural view of the joint of the present invention.
Figure 6B:
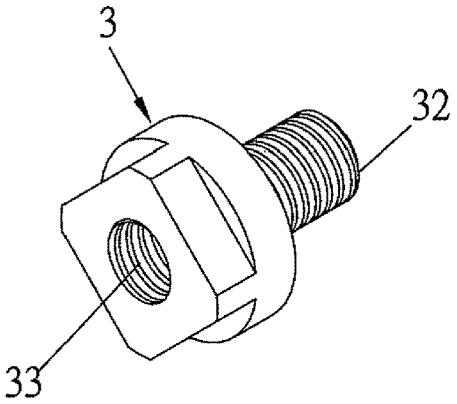
FIG. 6B is another structural view of the joint of the present invention.

Two joints 3 are installed at a bottom side of the rear cover 1 so that water flows into or out of the water tube set 2. As illustrated in FIG. 5, each joint 3 has an O shaped recess 31 for installing the O ring. One end of the joint 3 has outer threads and another end thereof has inner threads 33, as illustrated in FIGS. 6A and 6B.

Figure 8:
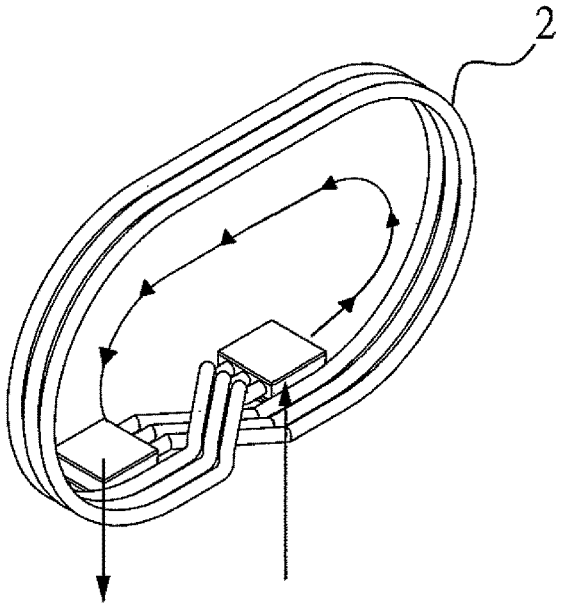
FIG. 8 shows the flow direction in the cooling structure of the present invention.

In the present invention, the two joints 3 are made of stainless steel, the outer threads 32 are M16 outer threads 32 and inner threads 33 are Rc3/8" inner threads 33. One end of the joint 3 is at an outer side of the rear cover 1. The two joints 3 pass through the two through holes 11 and O rings of the rear cover 1 and then the outer threads 32 of the joints 3 are connected to the inner threads 62 at lower sides of the water boxes 6 so that the water tube set 2 are tightly connected to the rear cover 1. Since the water boxes 6 are connected by threads, the water tube set 2 can be installed easily. After connection, cooling water flows from an outer side of one of the joints 3 to one water box 6 and then to the water tube set 2. Next, the water flows to another water box 6 and then to another joint 3 to flow out from this joint 3 so as to complete a circulation, as illustrated in FIG. 8.

In the present invention, preferably, the O ring is made of fluororubber. The O rings are used to seal the connection of the water tube set 2 and the rear cover 1 and seal the connection of the joint 3 and the rear cover 1. The O ring has a better effect than the prior art black glue sealing of screwing connection. The detaching work of O ring is convenient without the problem of dirty effect and drainage of black glue sealing.

In use of the two joints 3, the outer side of the joint 3 has inner threads 33 which are used to be connect to an external water pipe. Cooling water flows into one joint 3, and then to the water tube set 2 within the oil box 100 to absorb heat from the gears and lube oil without the oil box 100 and other elements, and then the water flows out of another joint 3. Therefore, the lubricate oil within the oil box 100 is cooled.

Advantages of the present invention are that the water tube set 2 has a crossing structure at the ends connected to the water box so that the length of the water tubes within the oil box can be maximized and thus the area for heat exchange is increased. Furthermore, the water tubes of the water tube set are parallel so that flowing cooling water has minimized resistance force and thus the cooling water could flow smoothly. In the structure of the present invention, the water tube set and the joints suspend in the oil box by the water boxes and the rear cover so that the water tubes are arranged above the two gears, that is, in the center of the oil box, which is beneficial to the uniform heat exchange. Therefore, cooling efficiency of the whole water tube set could be increased effectively. Therefore, the defects of too short cooling length, non-smoothness of the cooling water flow, bad cooling effect, inconvenience in detaching and installation, bad sealing after re-installation are resolved. Not only the cooling effect of the roots vacuum pump is incremented, but also the quality, safety and operation efficiency of the roots vacuum pump are also improved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An oil box device of a roots vacuum pump with a crossed cooling water tube set, comprising:

an oil box (100) formed by a roots pump rear cover (1) and an end cover (5); the rear cover and the end cover being formed as a cavity;

two roots vacuum pump transfer gears (4) placed within the oil box (100); the two gears being engaged with one another so that rotation of one gear will drive the other gear to rotate; each gear being axially connected to a respective one of shafts of rotors of the roots vacuum pump; one of the shafts of the rotors being driven by another one of the shafts of the rotors;

a multiple channel crossed cooling water tube set (2) enclosing the two roots vacuum pump gears (4) and being within the oil box; the cooling water tube set (2) being formed with a plurality of parallel water tubes; two distal ends of the water tube set being crossed over one another;

two water boxes (6) installed at two ends of the water tube set (2); after assembly, the water tube set enclosing the two gears and two ends of the water tube set being crossed over each other at a lateral side of the two gears;

two joints (3) installed at a bottom side of the rear cover (1) so that water flows into or out of the water tube set through the joints, the two joints passing through two through holes of the rear cover and then being connected to the water boxes so that the water tube set is tightly connected to the rear cover; and wherein after assembly, the two gears are arranged at an inner side of the water tube set so that the water tube set and the water boxes can dissipate heat of the gears; therefore, cooling water can flow into one of the joints; then flow to one of the two water boxes, then flow to the water tube set; then to the other water box, then to the other joint and flow out from the other joint.

2. The oil box device of a roots vacuum pump with a crossed cooling water tube set as claimed in claim 1, wherein the water boxes are connected to a plurality of short tubes (64); the short tubes are connected to the water tube set (2) and two ends of the water tube set are crossed over each other so that in a finite space, length of the water tube set is maximized and cool water has longer time to be retained in the oil box so as to increase a heat exchange rate.

3. The oil box device of a roots vacuum pump with a crossed cooling water tube set as claimed in claim 2, wherein the water tubes of the water tube set are parallel with the short tubes (64) so that flowing cooling water has minimized resistance force and thus the cooling water could flow smoothly; the water tube set (2) and the joints (3) suspend in the oil box (100) by the water boxes (6) and the rear cover so that the water tubes are arranged above the two gears.

4. The oil box device of a roots vacuum pump with a crossed cooling water tube set as claimed in claim 1, wherein a lower side of each of the water boxes has an inner threaded hole (62) and an O shape annular recess (63); a lateral side of each of the water boxes has a plurality of water holes (61), the number of which is corresponding to that of the water tubes of the water tube set; the water holes are used to connect a plurality of short tubes.

5. The oil box device of a roots vacuum pump with a crossed cooling water tube set as claimed in claim 4, wherein the water holes (61) are φ10 water holes (61); and the short tubes (64) are φ10 short tubes; and the inner thread (62) of each of the water boxes is M16 inner thread.

6. The oil box device of a roots vacuum pump with a crossed cooling water tube set as claimed in claim 1, wherein the two joints (3) are stainless steel joints; and one end of each joint has an M16 outer thread (32) and another end of the joint is a Rc318" inner thread (33).

7. The oil box device of a roots vacuum pump with a crossed cooling water tube set as claimed in claim 1, wherein an O ring is installed connecting each of the joints to a respective water box.

8. The oil box device of a roots vacuum pump with a crossed cooling water tube set as claimed in claim 1, wherein a gap between the water tube set (2) and the rear cover (1) is about 5~8 mm.

9. The oil box device of a roots vacuum pump with a crossed cooling water tube set as claimed in claim 1, wherein material of the water tube set is selected from stainless steel and yellow copper.

* * * * *